US006994058B2

(12) United States Patent
Iinuma et al.

(10) Patent No.: US 6,994,058 B2
(45) Date of Patent: Feb. 7, 2006

(54) COOLING APPARATUS FOR ENGINE

(75) Inventors: Masaaki Iinuma, Nishikamo-gun (JP); Kazunori Ota, Hazu-gun (JP); Shigetaka Yoshikawa, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/816,943

(22) Filed: Apr. 5, 2004

(65) Prior Publication Data

US 2004/0200443 A1 Oct. 14, 2004

(30) Foreign Application Priority Data

Apr. 9, 2003 (JP) ..... 2003-104776

(51) Int. Cl.
*F01P 11/02* (2006.01)

(52) U.S. Cl. ..... 123/41.14

(58) Field of Classification Search ..... 123/41.14, 123/41.01; 237/44, 75
See application file for complete search history.

(56) References Cited

U.S. PATENT DOCUMENTS 2,016,179 A * 10/1935 Rosenqvist ..... 123/41.14
5,159,910 A 11/1992 Ninomiya et al.
5,435,277 A * 7/1995 Takahashi ..... 123/142.5 E
5,662,072 A * 9/1997 Suzuki et al. ..... 123/41.14
5,730,089 A * 3/1998 Morikawa et al. ..... 123/41.14
5,749,329 A * 5/1998 Thurfjell ..... 123/41.14
6,477,990 B2 * 11/2002 Toyoshima et al. ..... 123/41.14
6,532,911 B2 * 3/2003 Suzuki et al. ..... 123/41.14
6,718,925 B2 * 4/2004 Toyoshima et al. ... 123/142.5 R
6,742,480 B2 * 6/2004 Onimaru et al. ..... 123/41.01

FOREIGN PATENT DOCUMENTS

| | | |
|---|---|---|
| EP | 1 197 645 A2 | 4/2002 |
| JP | A 10-86644 | 4/1998 |
| JP | A 2000-73764 | 3/2000 |
| JP | A 2002-138832 | 5/2002 |
| JP | A 2002-188442 | 7/2002 |

* cited by examiner

*Primary Examiner*—Henry C. Yuen
*Assistant Examiner*—Jason Benton
(74) *Attorney, Agent, or Firm*—Kenyon & Kenyon

(57) ABSTRACT

An engine cooling apparatus has a heat storage tank for storing and maintaining the temperature of cooling liquid let out of an engine into an engine cooling circuit. The heat storage tank is mounted in a vehicle so that a housing retained to a lower portion of a tank body forms a lowermost end portion of the engine cooling circuit in a vertical direction. An inlet passage of the housing is provided with a drain port. A portion (drooped portion) of a cooling liquid channel upstream of the drain port is lower than the position of the drain port in the vertical direction.

9 Claims, 6 Drawing Sheets

COOLING APPARATUS FOR ENGINE

INCORPORATION BY REFERENCE

The disclosure of Japanese Patent Application No. 2003-104776 filed on Apr. 9, 2003, including the specification, drawings and abstract is incorporated herein by reference in its entirety.

BACKGROUND OF THE INVENTION

1. Field of the Invention

The invention relates to a cooling apparatus for an engine and, more particularly, to an engine cooling apparatus designed so as to improve the efficiency in replacing a cooling liquid of an engine cooling circuit that includes a heat storage tank.

2. Description of the Related Art

Japanese Patent Application Laid-Open Publication No. 2002-188442 and No. 2000-73764 disclose engine cooling apparatuses in which a cooling circuit is provided with a heat storage tank for storing cooling liquid from an engine in a temperature maintaining fashion. The heat storage tank has a tank body and a housing. The housing has an inlet passageway for allowing cooling liquid to flow into the tank body and an outlet passageway for allowing cooling liquid to flow out from the tank body. An in-pipe passageway of a pipe inserted into the tank body is connected to the outlet passageway.

In order to maintain the engine cooling performance, it is necessary to periodically replace the cooling liquid. At the time of coolant replacement, a greater amount of cooling liquid needs to be drained if a heat storage tank is provided in the cooling circuit than if such a tank is not provided. Therefore, the provision of a heat storage tank can adversely affect the workability in replacing the cooling liquid, and can cause a prolonged replacement operation time.

Accordingly, it is an object of the invention to provide a cooling apparatus for an engine which incorporates a heat storage tank provided in a cooling circuit and which is designed to improve the efficiency in coolant replacement.

SUMMARY OF THE INVENTION

As one form of the invention, a cooling apparatus for an engine described below is provided. The cooling apparatus includes a cooling circuit of the engine, a tank body forming a heat storage tank that is mounted in a vehicle and that stores a cooling liquid let out via the cooling circuit and substantially maintains a temperature of the cooling liquid, a housing which has an inlet passage that lets the cooling liquid flow into the tank body, and an outlet passage that lets the cooling liquid flow out from the tank body, and which is positioned at a lowermost end portion of the cooling circuit in a vertical direction, and a drain port provided on the inlet passage for letting the cooling liquid out.

According to the above-described cooling apparatus, the heat storage tank is mounted in a vehicle so that the housing is retained to a lower portion of the tank body in the vertical direction and so that the housing becomes a lowermost end portion of the cooling circuit in the vertical direction. The housing is provided with the drain plug. Therefore, at the time of coolant replacement, a large amount of cooling liquid can be drained from the engine cooling circuit merely by operating the drain plug to open the drain port. Furthermore, since the drain plug is connected in communication to the inlet passage of the housing, the entire amount of cooling liquid in the heat storage tank can be drained. Hence, the efficiency in coolant replacement improves.

BRIEF DESCRIPTION OF THE DRAWINGS

The above mentioned embodiment and other embodiments, objects, features, advantages, technical and industrial significance of this invention will be better understood by reading the following detailed description of the exemplary embodiments of the invention, when considered in connection with the accompanying drawings, in which.

DESCRIPTION OF THE EXEMPLARY EMBODIMENTS

In the following description, the present invention will be described in more detail in terms of exemplary embodiments.

Figure 1:
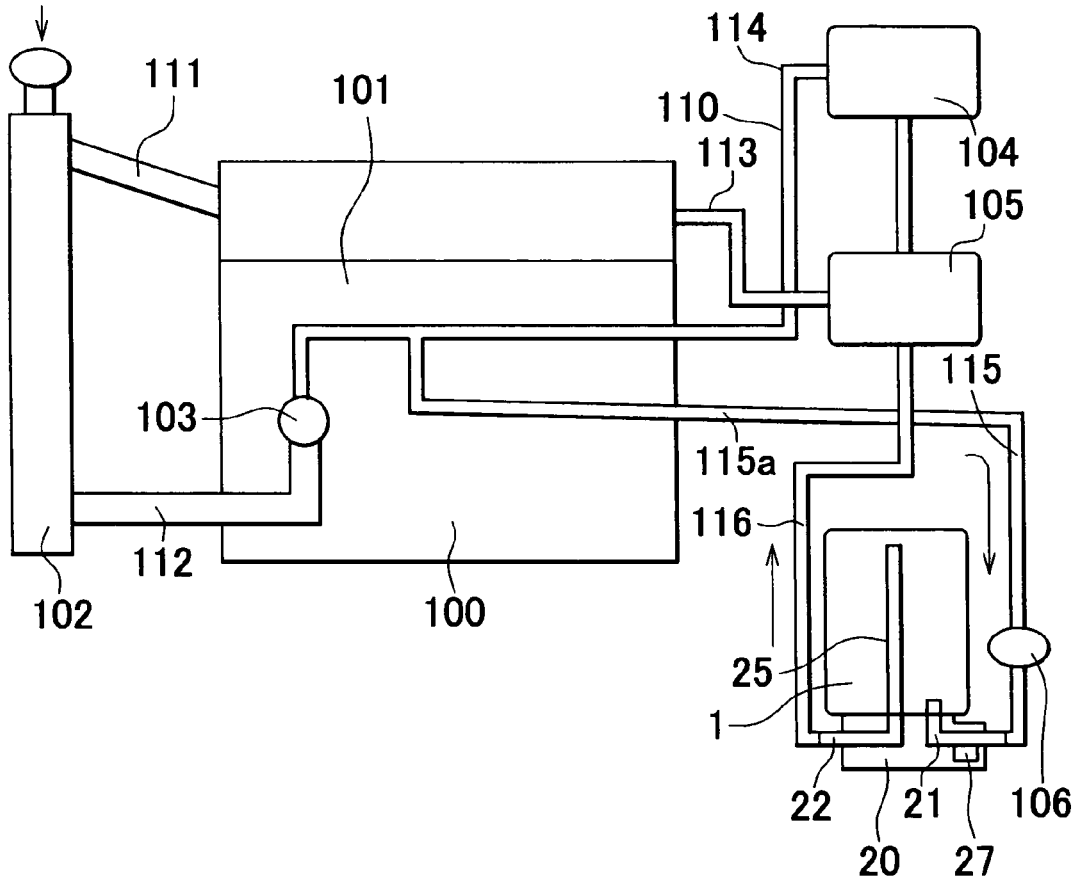
FIG. 1 is a system diagram schematically illustrating vertical positional relationships among various appliances in an engine cooling apparatus in accordance with the invention.

Referring to FIG. 1, an engine cooling apparatus 100 in accordance with the invention includes a heat storage tank 1 for storing cooling liquid let out from an engine and maintaining the temperature of the cooling liquid. The engine cooling apparatus 100 has a plurality of appliances and a cooling circuit 110 that travels through all the appliances. The drawings related to this embodiment indicate positional relationships among various appliances, with the downward direction in the drawings being defined as a downward in the vertical direction and the upward direction being defined as an upward direction in the vertical direction.

The appliances include an engine 101, a radiator 102, a water inlet 103, a heater core 104, a channel changeover valve 105, an electric water pump 106, and the heat storage tank 1. The electric water pump 106 is provided on a channel 115 connecting between the heat storage tank 1 and a channel 114 that extends from the heater core 104 to the water inlet 103.

The cooling circuit 110 includes a channel 111 extending from an engine cylinder head to the radiator 102, a channel 112 extending from the radiator 102 to an engine cylinder block via the water inlet 103, a channel 113 extending from the engine cylinder head to the heater core 104 via the channel changeover valve 105, a channel 114 extending from the heater core 104 to the engine cylinder block via the water inlet 103, the channel 115 extending from the channel 114 to the heat storage tank 1 via the electric water pump 106, and a channel 116 extending from the heat storage tank 1 to the channel changeover valve 105. FIG. 1 schematically shows the vertical positional relationships among the appliances. As shown in FIG. 1, the heat storage tank 1 is disposed at a lowermost position in the cooling circuit 110.

After warm-up of the engine, warmed cooling liquid is stored into the heat storage tank 1 in a thermally insulated fashion, by switching the channel changeover valve 105 to the side of the heat storage tank. During a preheat operation prior to startup of the engine, cooling liquid is delivered into the heat storage tank 1 via the channel 115 due to operation of the electric water pump 106. Then, the cooling liquid stored and thermally insulated in the heat storage tank 1 is forced out via the channel 116 to preheat the engine 101.

As shown in FIGS. 3 to 6, the heat storage tank 1 has a tank body 10 for storing and thermally insulating a liquid (cooling liquid), and a housing 20. The tank body 10 has a tank body opening portion 13 into which the housing 20 is inserted and fitted. The housing 20 has fluid passageways 21, 22 (the inlet passageway 21 and the outlet passageway 22 during preheat) for passage of fluid which communicate with an interior of the tank body 10.

The tank body 10 has an inner tank 11 and an outer tank 12. The inner tank 11 and the outer tank 12 are made of, for example, stainless steel. The inner tank 11 and the outer tank 12 welded together at a lower end of the tank body opening portion 13 (the welded portion between the inner tank 11 and the outer tank 12 is denoted by reference numeral 15). Due to the welding, the inner tank 11 and the outer tank 12 define an enclosed space 14 therebetween. The enclosed space 14 is substantially a vacuum. Due to the thermal insulation effect of vacuum, the enclosed space 14 thermally insulates the warmed cooling liquid introduced into the tank body 10. The warmed cooling liquid flows into the inner tank 11 via the fluid passageway 21 provided in the housing 20, and is stored and thermally insulated in the inner tank 11. The stored and thermally insulated cooling liquid is discharged from the heat storage tank 1 during preheat prior to startup of the engine or the like.

A flow-straightening member 16 (also termed anti-mixture plate) is provided in the inner tank 11. The flow-straightening member 16 uniformly straightens the incoming flows of cold cooling liquid, and causes the cooling liquid to flow upward of the flow-straightening member during preheat prior to startup of the engine or the like. The flow-straightening member 16 is gradually raised so as to prevent mixture of warm cooling liquid from above the flow-straightening member and cold cooling liquid from below the straightening member. The flow-straightening member 16 has a single pipe-insert hole 17, and many holes that uniformly straighten flows of cooling liquid.

The housing 20 is inserted and fitted into the inner peripheral side of the tank body opening portion 13. The housing 20 is made of, for example, resin. The housing 20 is equipped with a temperature sensor 23 whose detection portion faces the outlet passageway 22. The welded portion 15 between the inner tank 11 and the outer tank 12 of the tank body 10 is not covered from outside by the housing 20 in directions of the radius of the tank body opening portion 13. That is, the welded portion 15 is open radially outward of the tank body opening portion 13.

A pipe 25 is inserted and fixed to the housing 20. The in-pipe passageway is connected to the outlet passageway 22 of the housing 20 at a lower end of the pipe 25. At an upper end of the pipe 25, the in-pipe passageway is open to the space inside the inner tank 11 filled with cooling liquid. The pipe 25 extends through the pipe-insert hole 17 of the flow-straightening member 16. An intermediate portion of the pipe 25 is provided with a collar 26 that extends radially outward from the pipe 25. The collar 26 and a perimeter portion 18 of the pipe-insert hole 17 of the flow-straightening member 16 are not fixed to each other.

The tank body 10 is attached to and supported by an elongated member (e.g., a side member) 50 of the vehicle via a heat storage tank-mounting member 30. The housing 20 is attached to the heat storage tank-mounting member 30 via a housing support member 40. The heat storage tank-mounting member 30 and the housing support member 40 are made of, for example, metal.

The heat storage tank-mounting member 30 is not directly welded to the tank body 10. Instead, the heat storage tank-mounting member 30 is attached to the tank body 10 via an elastic member 39 that is wound around a barrel portion of tank body 10. The heat storage tank-mounting member 30 is a belt-like member having elasticity. The material of the elastic member 39 is, for example, rubber. The heat storage tank-mounting member 30 has a band (band-like bracket) 31. The heat storage tank-mounting member 30 further has a bracket 32. The bracket 32 is attached to the band 31 by, for example, spot welding or the like.

The band 31 has a cut on the periphery thereof. The band 31 is tightly wound around the tank body 10 via the elastic member 39 by fastening flanges formed on both ends of the band via a bolt 33 in the circumferential direction relative to the tank body 10. Due to this arrangement, it is not necessary to weld the band 31 to the tank body 10. The bracket 32 attached to the band 31 is supported by a vehicle-side bracket 51 via a rubber mount 55. The vehicle-side bracket 51 is attached to the elongated member 50 via bolts 52 and the like. Via this arrangement, the tank body 10 is supported by the elongated member 50.

The housing support member 40 includes a lifting bracket 41 and bolts 42, 43. The lifting bracket 41 is attached at an end thereof to an extension portion that extends below the band 31, via a plurality of bolts 43 (e.g., four bolts) aligned in the peripheral direction relative to the band. Another end of the lifting bracket 41 is fixed to the housing 20 via the bolts 42 and the like. Thus, the housing 20 is retained to the tank body 10 via the lifting bracket 41.

A first bracket 51A and a second bracket 51B are mounted on the elongated member 50, with a spacing left therebetween. Each of the first bracket 51A and the second bracket 51B has a portion that extends perpendicularly to the elongated member 50. If the elongated member 50 is a side member that extends in the longitudinal direction of the vehicle, the first bracket 51A and the second bracket 51B each have a portion that extends in the transverse direction of the vehicle. The two brackets are attached to the elongated member 50 with a spacing therebetween in the longitudinal direction of the vehicle.

The tank body 10 is disposed between the first bracket 51A and the second bracket 51B, with its axis directed in a vertical direction. The bracket 32 attached to the band 31 is mounted on the first bracket 51A and the second bracket 51B via the mount 55. Then, threaded fittings adjacent to an upper end of the mount 55 are fastened to the bracket 32. Threaded fittings adjacent to a lower end of the mount 55 are fastened to a lower end of the first bracket 51A and a lower end of the second bracket 51B. In this manner, the bracket 32 is fastened to the first bracket 51A and the second bracket 51B via the mount 55.

Figure 3:
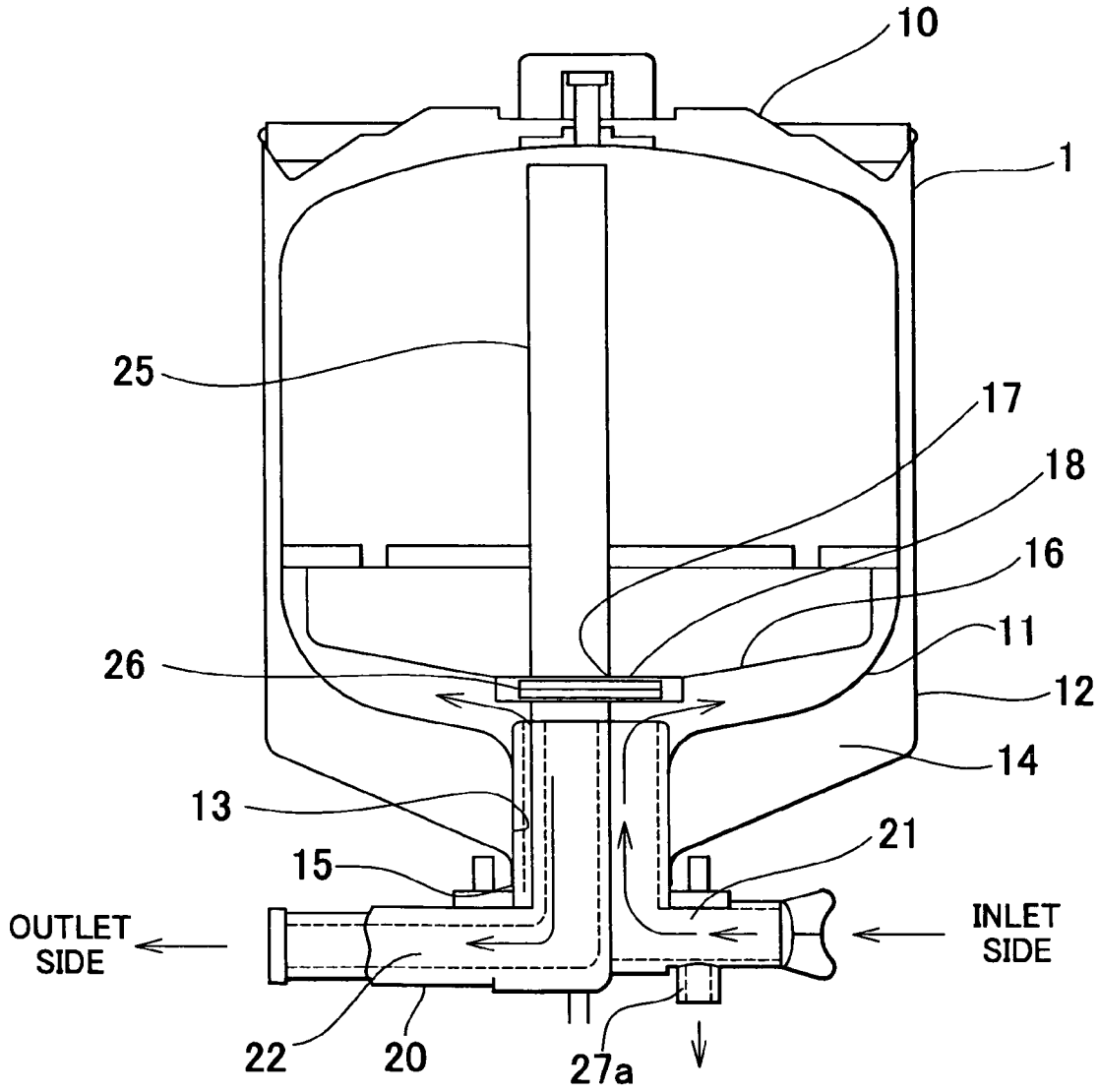
FIG. 3 is a sectional view of the heat storage tank forming the engine cooling apparatus in accordance with the invention.
Figure 4:
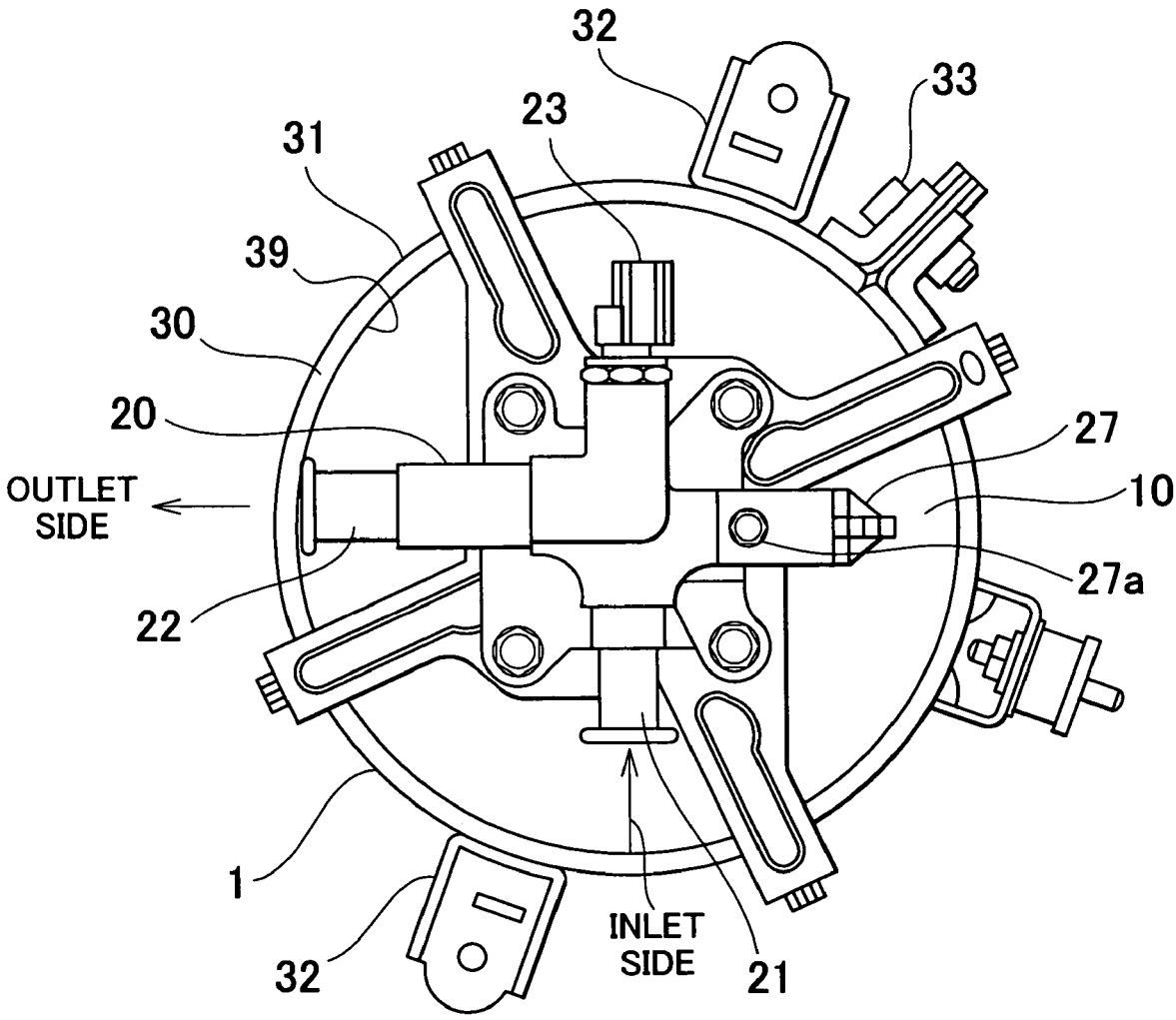
FIG. 4 is a bottom plan view of the tank shown in FIG. 3.

As shown in FIGS. 3 and 4, a drain plug 27 is attached to the housing 20. The drain plug 27 is attached to an exterior portion of the tank body 10 in such a manner that the drain plug 27 communicates with the fluid passageway 21. The heat storage tank 1 is mounted in a vehicle, with the axis thereof directed in the vertical direction, and the opening portion 13 facing downward, and the housing 20 retained to a lower portion of the tank body 10. In the vehicle-mounted state, the housing 20, more particularly, a drain port 27*a* provided in the inlet passageway 21, is positioned at a lowermost end portion of the engine cooling circuit 110 (FIG. 1), except for a drooped portion 28. If the drain plug 27 is loosened to open the drain port 27*a*, the cooling liquid in the engine cooling circuit flows out via the drain port 27*a*.

Figure 5:
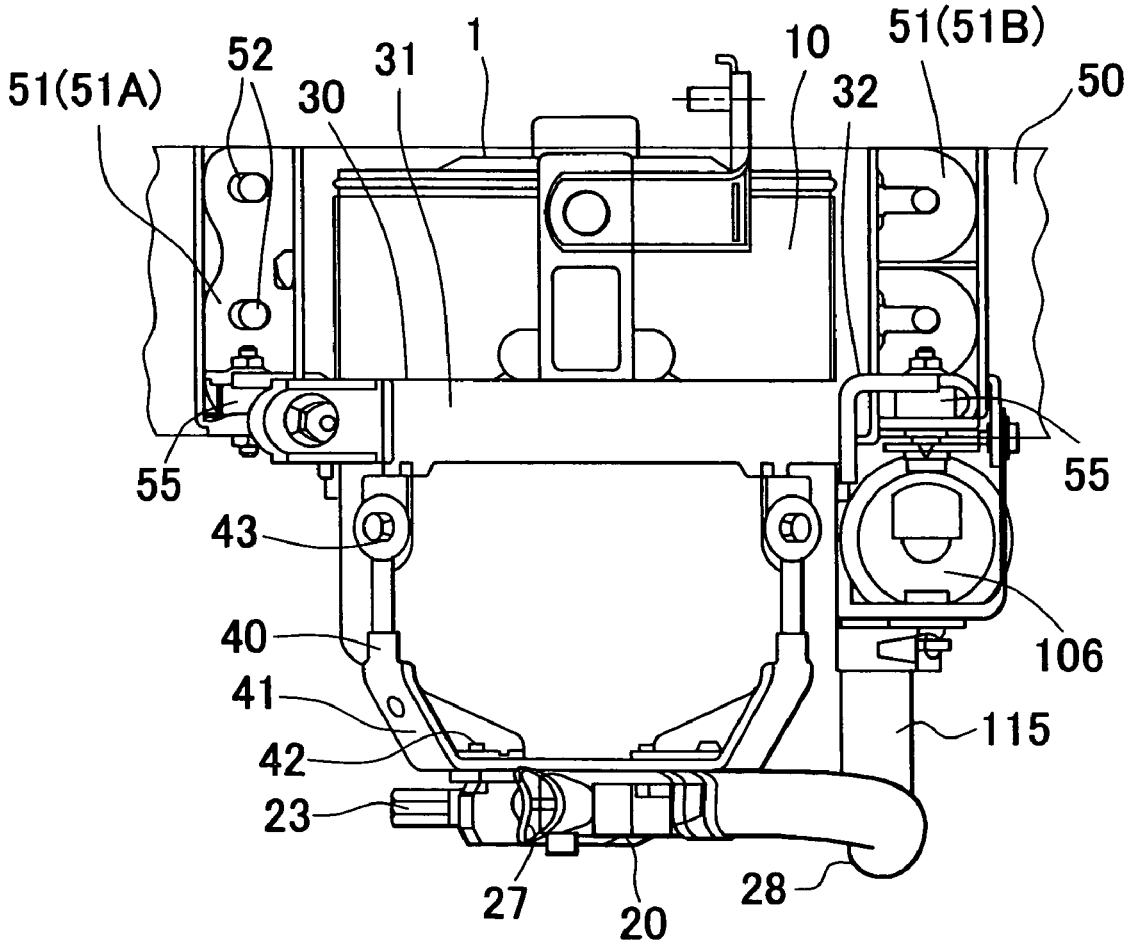
FIG. 5 is a side view of a heat storage tank forming the engine cooling apparatus in accordance with the invention, in a vehicle-mounted state.
Figure 6:
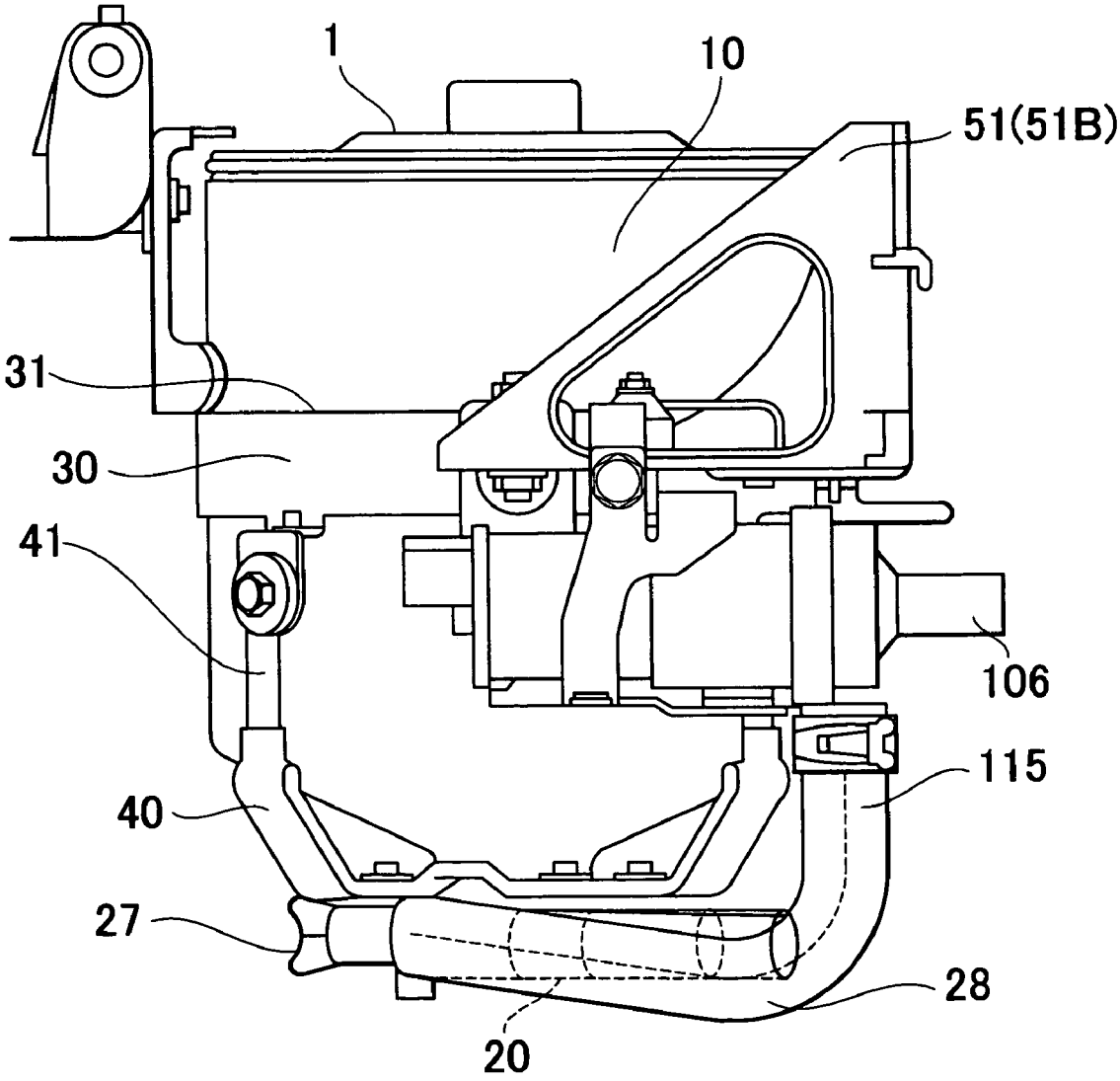
FIG. 6 is a rear view (viewed from the rear of the vehicle) of the heat storage tank forming the engine cooling apparatus in accordance with the invention, in the vehicle-mounted state.

The coolant channel 115 connected to an end of the inlet passageway 21 of the housing 20 which is upstream of the drain port 27*a* is a channel connecting between the heat storage tank 1 and the channel 114 extending from the heater core 104 to the water inlet 103. As shown in FIGS. 5 and 6, the coolant channel 115 connected to the upstream side of the drain port 27*a* (a side upstream of a branching point of a branch pipe of the inlet passageway 21 if the inlet passageway 21 has such a branch pipe and the drain port 27*a* is formed in the branch pipe) is laid out so that a portion of the channel 115 is positioned below the drain port 27*a*. Specifically, a drooped portion 28 is formed as a portion of the coolant channel 115. Of the piping that forms the channel 115, the portion that forms the drooped portion 28 is formed by, for example, a hose. That is, the drooped portion 28 is formed by curving the hose downwardly of the position of the drain port 27*a*.

Considering the workability of charging the coolant, the electric water pump 106 is mounted on the channel 115 between the engine 101 and the heat storage tank 1. A piping portion extending from the engine 101 to the electric water pump 106 is provided with such a slant that the piping progressively descends with approach to the electric water pump 106 (slant portion 115*a*). This design curbs accumulation of air in this piping portion (slant portion 115*a*).

In the conventional construction, drain plugs are provided in a lower portion of the radiator and a lower portion of the engine. In the invention, a drain plug is provided only at one site on the housing 20 of the heat storage tank 1. In the invention, it is also possible to provide drain plugs in a lower portion of the radiator and a lower portion of the engine in addition to the drain plug 27 provided on the housing 20 of the heat storage tank 1. The site of charging coolant into the cooling circuit 110 may be in an upper portion of the radiator 102, or may also be in an upper portion of the engine cooling circuit other than the radiator 102 or the vicinity of the upper portion. When coolant is to be drained from the drain port 27*a*, it is desirable to temporarily connect a hose to the outlet opening of the drain port 27*a* so as to increase the length of outlet. In this construction, the coolant can be drained quickly from the drain port 27*a*.

Next, operation of the engine cooling apparatus in accordance with the invention will be described. The coolant of the apparatus is periodically replaced. Since the heat storage tank 1 is provided, a correspondingly increased amount of coolant is needed. Therefore, at the time of periodic replacement, a large amount of coolant must be drained from the engine cooling apparatus. The amount of coolant required is, for example, about 5 liters for the engine system, and about 3 liters for the heat storage tank system. Thus, it is necessary to discharge at least a predetermined amount of coolant (which does not need to be the entire amount of coolant existing in the cooling circuit) in order to ensure good performance of coolant after replacement. It is also necessary to drain coolant from the heat storage tank 1. To drain coolant from the engine cooling circuit 110, a cap of a coolant inlet opening is removed, and the drain port 27*a* is opened by loosening the drain plug 27. Therefore, coolant flows out of the drain port 27*a*. In this case, as coolant flows out of the drain port 27*a*, air enters via an upper end of the radiator.

Provided that the liquid level of coolant is higher than the upper end of the heat storage tank 1 (a range A in FIG. 2), the liquid level in the engine cooling circuit 110 as a whole will drop if the drain port 27*a* is opened. The heat storage tank 1 is mounted in the vehicle so that the housing 20 retained to a lower portion of the tank body 10 is positioned at a lowermost end portion of the engine cooling circuit 110. The housing 20 is provided with the drain plug 27. In this arrangement, the position of the drain port 27*a* becomes the lowermost end of the engine cooling circuit 110, except for the drooped portion 28. Due to the great pressure head between the liquid level and the drain port 27*a*, the coolant can be drained forcefully and smoothly from the cooling circuit 110.

If in FIG. 2, the liquid level of coolant is at or below the upper end of the heat storage tank 1 but above the drain port 27*a* (in a range B in FIG. 2), the momentum of coolant flowing out of the drain port 27*a* draws the coolant in the outlet passageway 22 and the like upward through the in-tank pipe 25. If a hose is attached to the drain port 27*a*, the drawing force increases so that the draining characteristic further improves. Since the drain plug 27 is connected in communication to the inlet passageway 21 of the housing 20, the entire amount of coolant in the heat storage tank 1 can be drained. If the drain plug 27 is connected in communication to the outlet passageway 22, air enters the heat storage tank 1. Then, when an air accumulation forms in an upper end portion of the pipe 25, the coolant in the heat storage tank, being at a liquid level below the upper end of the pipe 25, cannot be drawn out via the outlet passageway 22. In the invention, however, since the drain plug 27 is connected in communication to the inlet passageway 21, the entire amount of coolant in the heat storage tank 1 can be drained even if an air accumulation forms in an upper end portion of the pipe 25.

However, the provision of only this construction allows drain breathing (i.e., a phenomenon that drainage repeatedly alternates between the state of good outflow from the drain port 27*a* and the state of substantially no outflow from the drain port 27*a*), and results in a long time of drain. To eliminate this problem, a portion of the channel 115 upstream of the drain port 27*a* is laid below the drain port 27*a*, that is, the drooped portion 28 is formed. Therefore, during coolant replacement, the drooped portion 28 remains filled with coolant, and a one-way air flow (in the coolant draining direction) is formed in the passageway within the pipe 25 or the channel 116 connected to the outlet passageway 22 of the housing among the various coolant channels. As a result, the oscillation of the liquid columns in the channel 115, the passageway within the pipe 25, and the channel 116 reduces, so that the entire amount of coolant in the tank can be smoothly drained in a short time without the breathing phenomenon. Therefore, the efficiency in coolant replacement will further improve. According to a test, this construction reduced the time needed to drain coolant to about one third of the drain time needed in a construction not provided with the drooped portion 28. The drooped portion 28 may be adjacent to the drain port 27*a*. According to the construction, coolant between the drain port and the drooped portion 28 is easily drained from the drain port 27*a*.

Figure 2:
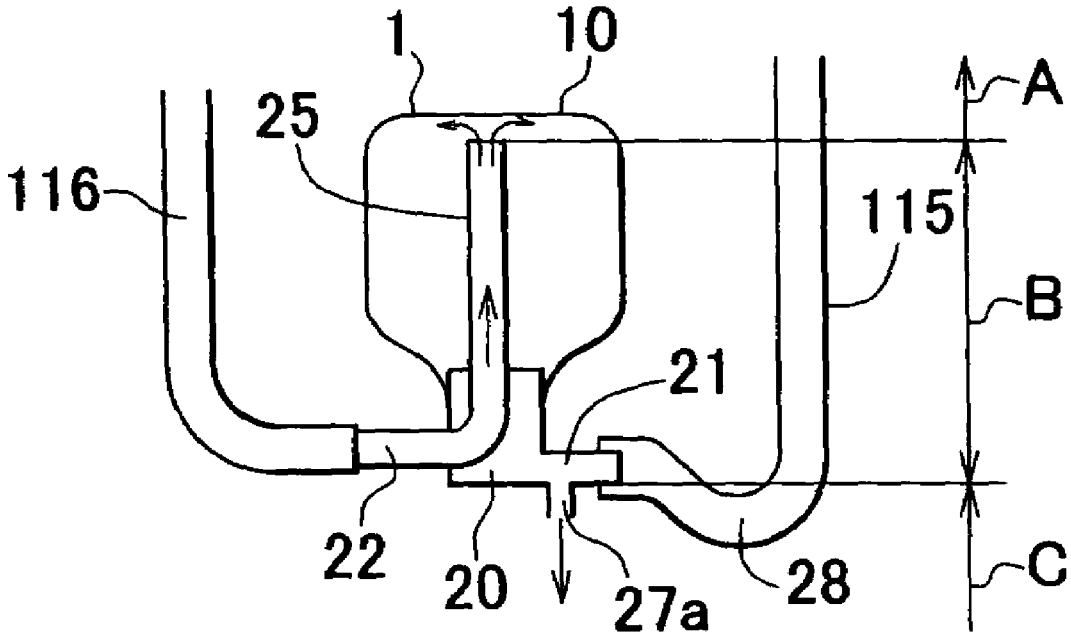
FIG. 2 is a schematic sectional view of a heat storage tank forming the engine cooling apparatus in accordance with the invention and its adjacent channels, illustrating a relationship between the level of cooling liquid in the heat storage tank and the operation of discharging the cooling liquid from the heat storage tank.

In FIG. 2, when the liquid level of coolant drops to or below the drain port 27*a* (to a range C in FIG. 2), the drooped portion 28 remains filled with coolant. At this time, air passageways have formed in the tank, the outlet passageway 22, and the coolant channel 116. That is, the entire amount of coolant has been drained from the heat storage tank system, except for the small amount of coolant in the drooped portion 28.

The tank interior structure does not allow the natural filling of water into the tank. Therefore, at the time of a water filling operation, water is charged in up to a level above the electric water pump 106, and then the electric water pump 106 is operated. In this manner, the tank can be filled with water. Since the channel 115 is provided with the slant portion 115*a*, air does not accumulate in the slant portion 115*a*, so that water can easily be charged in up to a level above the electric water pump 106.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A cooling apparatus for an engine, comprising:

a cooling circuit of the engine;

a tank body forming a heat storage tank that is mounted in a vehicle and that stores a cooling liquid let out from the engine via the cooling circuit and substantially maintains a temperature of the cooling liquid;

a housing which has an inlet passage that lets the cooling liquid flow into the tank body, and an outlet passage that lets the cooling liquid flow out from the tank body, and which is positioned at a lowermost end portion of the cooling circuit in a vertical direction; and a drain port provided on the inlet passage for letting the cooling liquid out, wherein a portion of the inlet passage upstream of the drain port is disposed at a position that is lower than a position of the drain port in the vertical direction.

2. The cooling apparatus according to claim 1, wherein the portion of the inlet passage upstream of the drain port is adjacent to the drain port.

3. The cooling apparatus according to claim 1, wherein the portion of the inlet passage upstream of the drain port is disposed so that a liquid level of the cooling liquid in the portion of the inlet passage is lower than the drain port in the vertical direction.

4. The cooling apparatus according to claim 1, wherein the portion of the inlet passage upstream of the drain port is formed by a hose.

5. The cooling apparatus according to claim 1, wherein the drain port is connected to a lower end of the inlet passage in the vertical direction.

6. The cooling apparatus according to claim 1, further comprising a drain plug connected to the inlet passage for adjusting opening and closing of the drain port.

7. The cooling apparatus according to claim 1, further comprising a drain piping connected to the drain port.

8. The cooling apparatus according to claim 7, wherein the drain piping is formed by a hose.

9. The cooling apparatus according to claim 1, wherein a channel between the heat storage tank and the engine which forms the cooling circuit is provided with a pump for delivering the cooling liquid to the heat storage tank, and wherein the channel between the pump and the engine has such a slant that the channel becomes lower in the vertical direction with approach to the pump.

* * * * *